United States Patent [19]

Patterson

[11] 4,196,899

[45] Apr. 8, 1980

[54] CONTEMPLATION DEVICE

[76] Inventor: James A. Patterson, 4151 Middlefield Rd., Palo Alto, Calif. 94303

[21] Appl. No.: 902,720

[22] Filed: May 4, 1978

[51] Int. Cl.[2] ..... G09F 19/00

[52] U.S. Cl. ..... 272/1 R; 40/406; 273/161

[58] Field of Search ..... 272/8 R, 8 D, 1 R; 273/1 L, 161; 40/406, 407, 410; 220/352, 353, 354, 364

[56] References Cited

U.S. PATENT DOCUMENTS

| | | | |
|---|---|---|---|
| 2,686,642 | 8/1954 | Dobarganes et al. | 40/406 X |
| 3,011,950 | 12/1961 | Mehaffey | 272/8 D UX |
| 3,464,132 | 9/1969 | Matisse | 40/407 |
| 3,716,233 | 2/1973 | Kotwas et al. | 273/1 L |
| 4,023,289 | 5/1977 | Crawford | 40/410 |
| 4,085,533 | 4/1978 | Ewald | 40/406 |

*Primary Examiner*—Anton O. Oechsle

*Attorney, Agent, or Firm*—Limbach, Limbach & Sutton

[57] ABSTRACT

A contemplation device is disclosed taking the form of a transparent container having a substantially spherical portion, a supporting base portion and a neck portion between the spherical portion and the base portion for receiving a sealing stopper for sealing in the container a saline solution substantially filling the container, but leaving at least some space and supporting in suspension a multiplicity of spherical, different colored beads which have a specific gravity the same as that of the solution. The stopper is sealed with a silicon rubber sealant.

2 Claims, 3 Drawing Figures

FIG.1
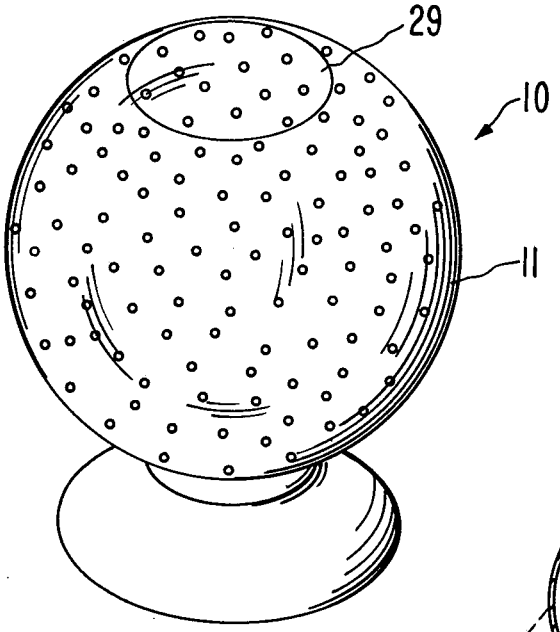
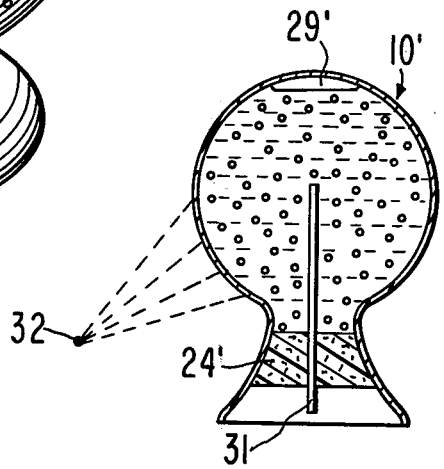
FIG.3
FIG. 2
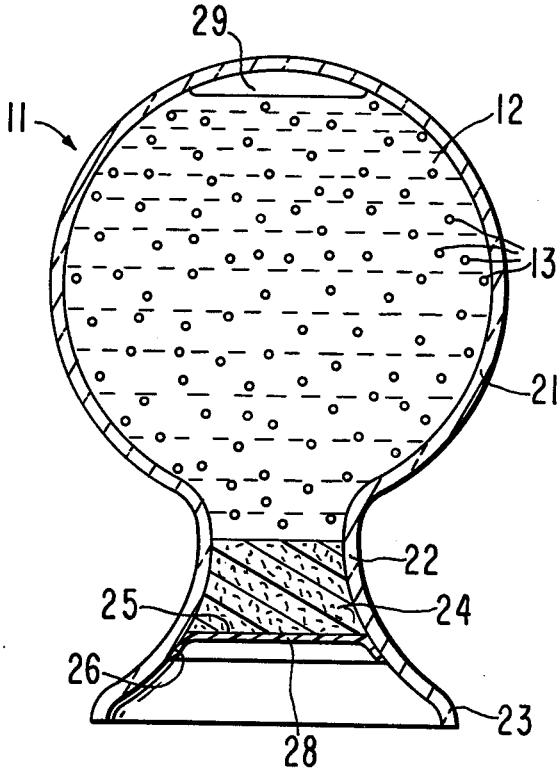

CONTEMPLATION DEVICE

BACKGROUND OF THE INVENTION

The present invention relates in general to products which can be used for contemplation, either for amusement or for psychic phenomena.

Some contemplation devices have been constructed in the past having materials partially suspended in a transparent solution in a transparent container. Movement of the article will stir up the particles which then settle and present a display for contemplation. Zero gravity conditions have also been encountered by astronauts wherein small changes in the energy within a system will cause movement within that system.

SUMMARY OF THE INVENTION

The present invention is directed to a device comprising a hollow transparent container, preferably spherical, containing a solution in which are suspended a multiplicity of spherical beads with the specific gravity of the beads and the solution matched.

Apparatus of this construction provides a device for contemplation either as amusement or in the study of psychic phenomena. The spherical beads can absorb energy at different rates among themselves depending upon their physical characteristics, typically their color, and from the solution in which they are suspended so that different actions will result.

In the preferred embodiment of the present invention the multitude of spherical beads include beads of many different colors which add to the overall visual affect and operation achieved with the device.

In accordance with other aspects of the present invention the device can be provided with illumination means, such as a light pipe projecting thereinto or an external device for applying energy, such as illumination, to the device.

The foregoing and other objectives, features and advantages of the invention will be more readily understood upon consideration of the following detailed description of certain preferred embodiments of the invention, taken in conjunction with the accompanying drawings.

DESCRIPTION OF THE DRAWINGS

FIG. 1 is a perspective view of the device in accordance with the present invention.

FIG. 2 is a side elevational sectional view of the device in accordance with the present invention.

FIG. 3 is a side elevational sectional view showing other embodiments of the present invention.

DESCRIPTION OF THE PREFERRED EMBODIMENT

Referring now to the drawing, with particular reference to FIGS. 1 and 2, there is shown a contemplation device 10 in accordance with the present invention. The device comprises a hollow transparent container 11 containing a fluid solution 12 in which is suspended a multiplicity of spherical beads 13 with the beads having a specific gravity substantially the same as the fluid solution 12. In the preferred embodiment of the invention the spherical beads 13 include beads of many different colors.

While the container can take various different shapes, the present invention is principally utilized with a container which includes a hollow, substantially spherical portion 21 in which the fluid solution 12 is primarily contained and a cup-shaped base portion 23 which serves to support the device 10 on a supporting surface. A neck portion 22 is provided between the spherical portion 21 and the base portion 23 is enable sealing the fluid 12 in the spherical portion 21. Sealing means are provided in the form of a compressible stopper 24 which can be force fitted into the neck portion 22 and provided with a sealing coating 28 fully sealing the fluid solution 12 in the container 11.

While the container 11 can be made of a number of different transparent materials, a clear glass vial is a suitable member for this aspect of the invention.

The spherical beads 13 are selected as beads of substantially uniform specific gravity and can be of various diameters, as well as being of various different colors. Ideally suited for this application are beads which are copolymers the type generally described in U.S. Pat. No. 2,366,007 to D'Alelio. The copolymers are formed by a conventional catalyzed polymerization reaction and are made from a monovinyl aryl compound, such as styrene (vinyl benzene), vinyl toluenes, vinylnaphthalenes, vinyl ethyl benzenes, alphamethyl-styrene, vinyl chlorobenzenes and vinyl xylenes. The selected monomer is cross-linked with a suitable polyvinyl aryl compound, such as the divinyl benzenes, divinyl toluenes, divinyl naphthalenes, divinyl xylenes, divinyl ethyl benzenes, divinyl chlorobenzenes and divinyl-phenyl vinyl ethers. Preferred beads for present purposes are made from styrene cross-linked with divinyl benzene. The density of these beads is in a range of 1.05 $gm/cm^3$ to 1.07 $gm/cm^3$.

The beads are suspended in a solution of matched specific gravity which ideally can be achieved by a saline solution which allows the beads to float at zero gravity. The balanced specific gravity can be accomplished by arranging the beads in a saline solution at typical atmospheric conditions, preferably 70° F. and 760 milimeters of mercury pressure, and adding water to the solution until the specific gravity of the solution is matched to that of the beads. When the specific gravities are matched, the combination is placed into the container 11 and sealed therein preferably leaving some space unfilled by the saline solution. The space or bubble 29 which is left unfilled enables better mixing of the bead-solution by movement of the device 10.

It is important that a good seal be accomplished in the device to prevent evaporation of any water from the container which would result in a change in the specific gravity of the fluid and therefore change the match of the specific gravity of the beads and the solution. The seal is accomplished by the stopper 24 inserted into the neck portion 22 of the container. There are various methods of closing the stopper to trap the appropriate amount of solution and open space. In the preferred embodiment of the present invention the stopper 24 takes the form of an expanded polystyrene material which can be inserted into the neck portion 22 with a small rigid teflon tubing along the interface between the stopper 24 and the glass of the neck portion 20 of the container for achieving the desired remaining open space in the enclosed portion of the container. Upon insertion of the stopper 24 to the desired degree, the tube can be removed whereby the stopper then makes a seal around its periphery with the neck portion 22 of the container. The final complete seal is made by applying a layer of sealant 28 over the exposed surface 25 of the stopper and the adjacent exposed neck portions 26 at the periphery of the stopper. It has been found that a silicone rubber sealant provides a good sealant which not only bonds to the glass container and the stopper material, but also provides an impervious seal against the loss or evaporation of any fluid.

A cork stopper could be used and a hypodermic needle passed through the stopper for the filling operation.

A saline solution is especially desirable because it is non-toxic, low cost, pure, transparent, and easily matched to the density of the speherical beads.

It has been discovered that the cross-linked polymer beads can best be colored using food dyes which impart to the beads a wetting characteristic and avoid attachment of minute air bubbles onto the beads which would disrupt the intended function for the device. It has been found that the copolymer beads can be colored with the food dyes by first expanding the matrix of the beads with methylene chloride. The food dye is then placed in an alcohol solution and mixed with the methylene chloride until the desired color is achieved. The mixture is then heated to above 40° C. to drive off the methylene chloride and alcohol and dry the beads. The beads are washed with dionized water until the free coloring is removed and then the beads are dryed ready for use.

The spherical geometry for the beads is important because it gives the minimum volume for the material being used, which is important for sensing the energy received by the particles in the system. Additionally, irregular shapes would more likely entrap air on the particles and not provide a system with a uniform match between the beads and the solution.

Various modifications can be made to the device in accordance with this invention. For example, different methods and means can be utilized to provide energy, such as illumination, to the system. As shown in FIG. 3 a transparent or translucent light pipe 31 can be provided through the stopper 24' for transmitting light energy into the container 11. Alternatively, the container 11' can be illuminated from an exterior source, such as a point light source 32 which will produce various visual affects besides the transfer of energy to the beads in the solution. The use of a monochromatic light source or the periodic light filtering of the illumination from the source 32 which passes into the device 10, can add to the affects produced by the device.

Besides serving as an amusement device the device 10 can also be used for evaluation of psychic phenomena. In one such use the device can be contemplated from a distance so that discrete beads can be seen. A specific bead can be selected and concentrated upon initially and then the concentration gradually enlarged to include all of the beads. The device can also be used in stress therapy in the management of psychological and physiological affects of mental stress. The device can also be utilized for subconscience learning and mind trip focus by using the device as a point of focus, departure and return to focus.

While the device can be constructed in various sizes typical sizes include a container spherical portion 2¾", 3½" or 4½" in diameter incorporating beads with a mean diameter of approximately 500 to 900 microns.

What is claimed is:

1. A contemplation device comprising, in combination, a transparent container having a hollow substantially spherical portion, and a neck portion between said spherical portion and said base portion, means sealing off said spherical portion of said container at said neck portion including an expanded polystyrene stopper and a silicone rubber sealant covering the entire exposed surface of said stopper and the immediately adjacent portions of said container, a saline solution substantially filling said sealed off portion of said container leaving at least some space unfilled with saline solution, and a multiplicity of spherical beads suspended in said solution, the specific gravity of said beads being the same as the specific gravity of said solution.

2. A contemplation device comprising:

a transparent container, a multiplicity of spherical beads of different sizes and of different colors and all of styrene cross-linked with divinyl benzene of substantially uniform specific gravity, a saline solution filling a portion of said container except for said beads and an air space, means sealing off said portion of said container leaving only said saline solution, said beads and said air space therein, the specific gravity of said saline solution matched to the specific gravity of said beads at atmospheric conditions of 70° F. and 760 millimeters of mercury pressure.

* * * * *